US006502416B2

(12) United States Patent
Kawasumi et al.

(10) Patent No.: US 6,502,416 B2
(45) Date of Patent: Jan. 7, 2003

(54) AUTOMATIC ICE MAKER OF THE OPEN-CELL TYPE

(75) Inventors: Masaaki Kawasumi, Shimane-ken (JP); Masahiro Kodani, Izumo (JP); Shinichi Nagasawa, Izumo (JP); Chiyoshi Toya, Nagoya (JP); Shinsaku Hayakawa, Nagoya (JP); Masaru Wada, Izumo (JP); Kiyoharu Nishimura, Toyotake (JP)

(73) Assignee: Hoshizaki Denki Kabushiki Kaisha, Toyoake (JP)

( * ) Notice: Subject to any disclaimer, the term of this patent is extended or adjusted under 35 U.S.C. 154(b) by 0 days.

(21) Appl. No.: 09/833,197

(22) Filed: Apr. 12, 2001

(65) Prior Publication Data

US 2002/0002836 A1 Jan. 10, 2002

(30) Foreign Application Priority Data

Apr. 12, 2000 (JP) ..... 2000-111005

(51) Int. Cl.[7] ..... F25C 1/00

(52) U.S. Cl. ..... 62/347; 249/81; 249/119; 249/160

(58) Field of Search ..... 62/347, 348, 352; 249/81, 119, 120, 139, 160

(56) References Cited

U.S. PATENT DOCUMENTS

| | | | | | |
|---|---|---|---|---|---|
| 5,304,904 | A | * | 4/1994 | Sakai | 62/347 |
| 5,329,780 | A | * | 7/1994 | Broadbent | 62/347 |
| 5,722,244 | A | * | 3/1998 | Shelton | 62/347 |
| 5,941,091 | A | * | 8/1999 | Broadbent | 62/347 |
| 6,062,036 | A | * | 5/2000 | Hobelsberger | 62/347 |

* cited by examiner

*Primary Examiner*—William E. Tapoloai
*Assistant Examiner*—Mohammad M. Ali
(74) *Attorney, Agent, or Firm*—Arent Fox Kintner Plotkin & Kahn, PLLC

(57) ABSTRACT

An automatic ice maker of the open-cell type including a box-type housing, a plurality of spaced ice making cell casings arranged on a horizontal plane in an upper portion of the housing and opened downward, a cooling pipe mounted on the cell casings to be supplied with refrigerant from a freezing circuit, and a sprinkler mounted within a bottom portion of the housing and placed under the cell casings to spout ice making water into the respective cell casings, wherein a base plate is mounted within the upper portion of the housing to form an ice making chamber, and wherein the ice making cell casings are secured to a bottom surface of the base plate, while the cooling pipe is mounted on the base plate at positions located above the cell casings and welded to an upper surface of the base plate.

6 Claims, 9 Drawing Sheets

Fig.9 (a) RELATED ART
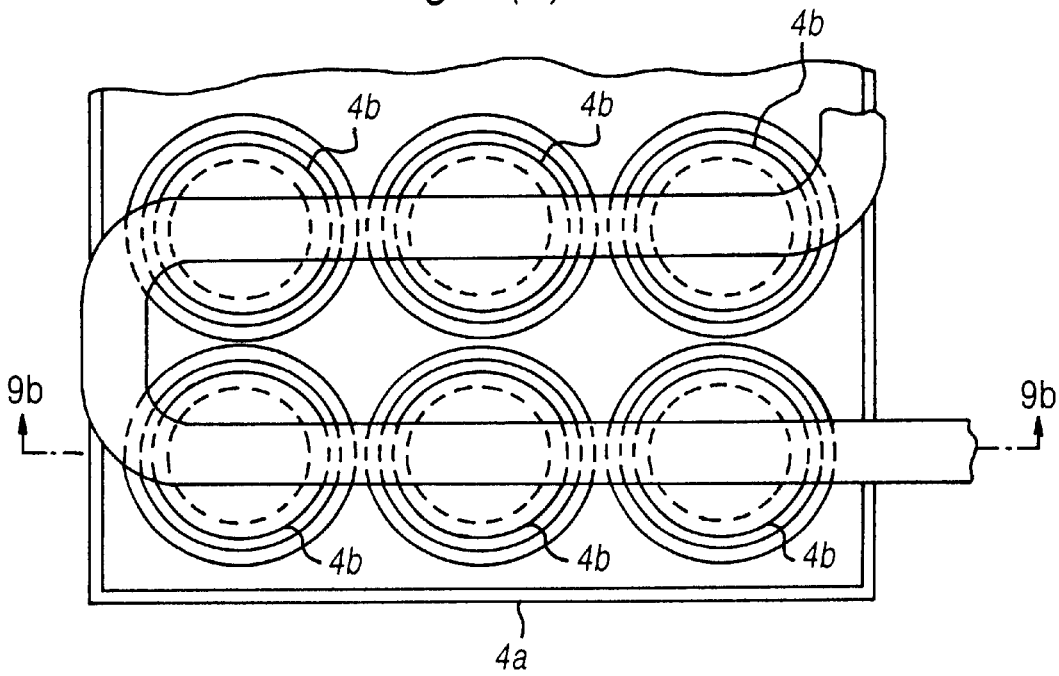
Fig.9 (b) RELATED ART
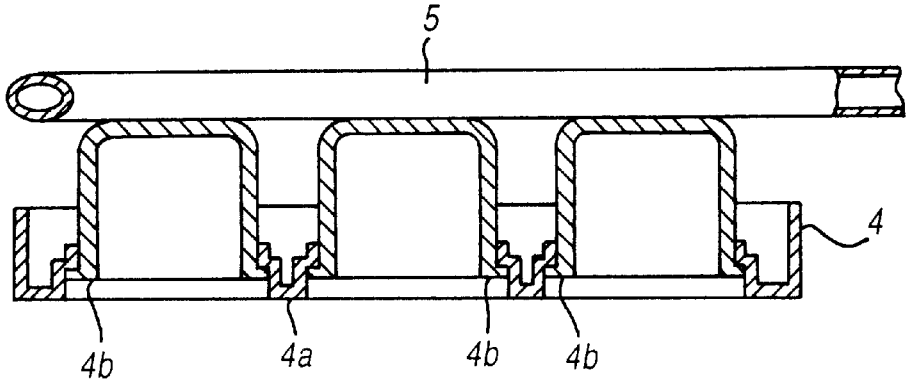

AUTOMATIC ICE MAKER OF THE OPEN-CELL TYPE

BACKGROUND OF THE INVENTION

1. Field of the Invention

The present invention relates to an automatic ice maker of the open-cell type.

2. Discussion of the Prior Art

Illustrated in FIG. 8 is a conventional automatic ice maker of the open-cell type which includes a box type housing 1 composed of a pair of side walls 1*a* connected to each other by means of rear and front walls 1*b* and 1*c*, a water storage tank 2 mounted to a bottom portion of housing 1, a sprinkler 3 provided with a plurality of nozzles 3*a* and mounted on the water storage tank 2, an ice making dish plate 4*a* mounted within an ice making chamber 4 formed in an upper portion of housing 1, a plurality of cup-shaped ice making cell casings 4*b* coupled with the corresponding holes of the dish plate 4*a* and welded in place, and an inclined ice chute 6 in the form of a lattice located under the ice making cell casings 4*b* and mounted to the side walls 1*a* of housing 1. The ice making cell casings 4*b* are arranged to open downward. In addition, a shutter 7 is suspended from the front wall 1*c* of housing 1 and is normally closed by weight. During the defrost cycle in operation of the ice maker, fresh water is supplied to the dish plate 4*a* by means of a water supply conduit 8. When the defrost cycle in operation of the ice maker finishes, the water is discharged from a drain passage (not shown).

A cooling pipe 5 fixedly mounted on the ice making cell casings 4*b* as shown in FIGS. 9(*a*) and 9(*b*) is connected to a refrigerant conduit 10 to be supplied with cooled refrigerant from a freezing circuit including a compressor 11, a condenser 12 cooled by a cooling fan 13, a dehydrator 14 and an expansion valve 15. In the freezing circuit, a hot-gas valve 16 is provided in parallel with the condenser 14, dehydrator 14 and expansion valve 15. When the freezing circuit is activated in a closed condition of the hot-gas valve 16, the ice making chamber 4 is cooled by the refrigerant supplied from the freezing circuit. When the hot-gas valve 16 is opened in a closed condition of expansion valve 15, the refrigerant is compressed by the compressor 11 and supplied as a hot-gas to the cooling pipe 5.

Ice making water W in water tank 2 is supplied into the sprinkler 3 and spouted upward from the nozzles 3*a* of sprinkler 3. The water is spouted across openings of the ice chute 6 into each interior of ice making cell casings 4*b* cooled by the refrigerant and frozen in the ice making cell casings 4*b*, and a remainder of the water is returned into the water tank 2. Ice cubes formed in the ice making cells 4*b* are enlarged in the course of lapse of a time. When the ice making cell casings 4*b* are filled with the ice cubes, the water for defrost is supplied to the dish plate 4*a*, and the hot-gas is supplied to the cooling pipe 5 to release the ice cubes from the ice making cell casings 4*b*. The ice cubes are received by the ice chute 6 and slip on the ice chute to open the shutter 7. Thus, the ice cubes are delivered into an ice storage cabinet (not shown) through the shutter 7.

In the ice maker, as shown in FIGS. 9(*a*) and 9(*b*), the cooling pipe 5 is secured in contact with the ice making cell casings 4*b* and is partly separated from the ice making cell casings at each space therebetween. Accordingly, at an ice making cycle in operation, heat transfer of the refrigerant is effected only at a portion of the cooling pipe 5 in contact with the ice making cell casings 4*b*, while the cooling pipe 5 does not effect heat transfer of the refrigerant at a portion separated from the ice making cell casings 4*b*. This results in a decrease of heat exchange efficiency of the cooling pipe 5, causing a decrease of ice making performance of the ice maker.

SUMMARY OF THE INVENTION

It is, therefore, a primary object of the present invention to provide an automatic ice maker of the open-cell type the cooling performance of which is enhanced in a simple construction.

According to the present invention, the object is accomplished by providing an automatic ice maker of the open-cell type which includes a box-type housing, a plurality of spaced ice making cell casings arranged on a horizontal plane in an upper portion of the housing and opened downward, a cooling pipe mounted on the cell casings to be supplied with refrigerant from a freezing circuit and a sprinkler mounted within a bottom portion of the housing and placed under the cell casings to spout ice making water into the respective cell casings, wherein a base plate is mounted within the upper portion of the housing to form an ice making chamber, and wherein the ice making cell casings are secured to a bottom surface of the base plate, while the cooling pipe is mounted on the base plate along positions located above the cell casings and welded to an upper surface of the base plate.

In a practical embodiment of the present invention, the ice making cell casings each are in the form of a cylindrical body welded at one end thereof to the bottom surface of the base plate. Alternatively, the ice making cell casings each are in the form of a cup-shaped casing welded at its bottom to the bottom surface of the base plate by braze welding.

According to an aspect of the present invention, the ice making cell casings each are in the form of a cylindrical body formed at one end thereof with a plurality of projections which are inserted into the corresponding mounting holes formed in the base plate and folded in a condition wherein the one end of the cylindrical body is retained in contact with the bottom surface of the base plate.

According to another aspect of the present invention, the base plate is formed with a plurality of mounting holes located at positions corresponding with the ice making cell casings, wherein the ice making cell casings each are in the form of a cup-shaped casing formed at its bottom with an annular flange which is coupled with the respective mounting holes of the base plate and welded to the base plate in a condition where the bottom of the cup-shaped casing coincides with the upper surface of the base, and wherein the cooling pipe is welded to the upper surface of the base plate in its entire length.

According to a further aspect of the present invention, the ice making cell casings are integrally formed with the bottom surface of the base plate, while the cooling pipe is mounted on the base plate along positions located above the cell casings and welded to the upper surface of the base plate. In this embodiment, it is preferable that the base plate is formed thereon with a support portion along positions located above the cell casings, and that the cooling pipe is positioned in engagement with the support portion of the base plate and welded to the base plate.

DESCRIPTION OF THE DRAWINGS

Other objects, features and advantages of the present invention will be more readily appreciated from the following detailed description of preferred embodiments thereof when taken together with the accompanying drawings, in which:

FIG. 2(*b*) is a sectional view of the cooling pipe taken along line 2*b*—2*b* in FIG. 2(*a*);

FIG. 3(*b*) is a sectional view of the cooling pipe taken along line 3*b*—3*b* in FIG. 3(*a*);

FIG. 4(*b*) is a sectional view of the cooling pipe taken along line 4*b*—4*b* in FIG. 4(*a*);

FIG. 4(*c*) is a perspective view of an ice making cell casing removed from a mounting base plate shown in FIG. 4(*b*);

FIG. 4(*d*) is a perspective view of a modification of the ice making cell casing shown in FIG. 4(*c*);

FIG. 5(*b*) is a sectional view of the cooling pipe taken along line 5*b*—5*b* in FIG. 5(*a*);

FIG. 6(*b*) is a cross-sectional view of the cooling pipe taken along line 6*b*—6*b* in FIG. 6(*a*);

FIG. 7(*b*) is a cross-sectional view of the cooling pipe taken along line 7*b*—7*b* in FIG. 7(*a*);

FIG. 7(c ) is a cross-sectional view of the cooling pipe taken along line 7*c*—7*c* in FIG. 7(*a*);

FIG. 9(*a*) is a plan view of a cooling pipe in the ice maker shown in FIG. 8; and FIG. 9(*b*) is a sectional view of the cooling pipe taken along line 9*b*—9*b* in FIG. 9(*a*).

DESCRIPTION OF THE PREFERRED EMBODIMENTS

Figure 1:
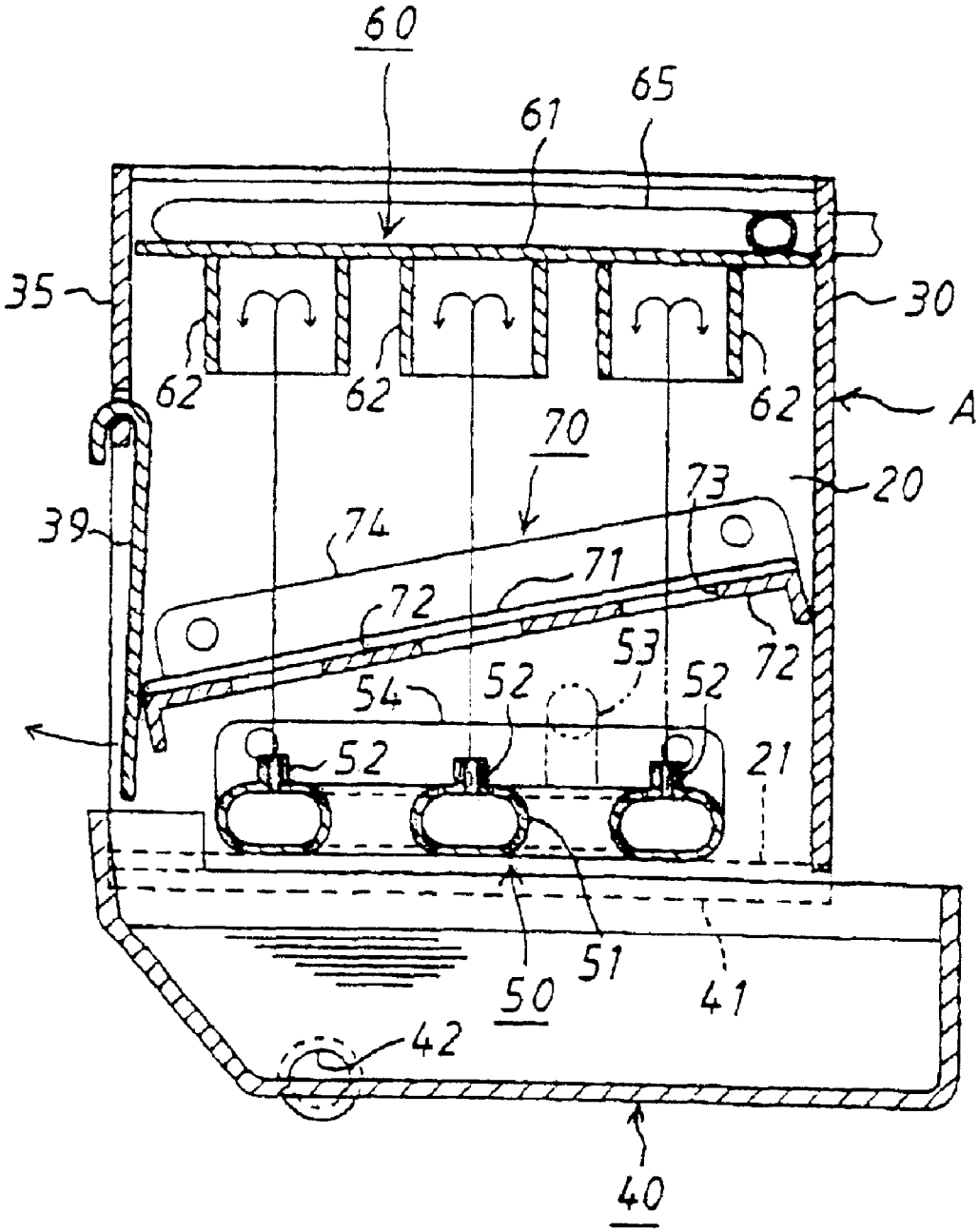
FIG. 1 is a vertical sectional view of an automatic ice maker of the open-cell type in accordance with the present invention.

Illustrated in FIG. 1 of the drawings is an automatic ice maker of the open-cell type in accordance with the present invention which is composed of a box-type housing A, a water storage tank 40 mounted to the bottom of housing A, a sprinkler 50 mounted on the bottom of housing A, an ice making chamber 60 formed in an upper portion of housing A, and an ice chute 70 mounted within the housing A at a portion located under the ice making chamber 60.

The box-type housing A is composed of a pair of side walls 20 connected to each other by means of front and rear walls 35 and 30. The front wall 35 is formed smaller in vertical width than the rear wall 30 to open a lower half portion of the front of housing A. The front opening of housing A is closed by a shutter 39 suspended from the front wall 35. A pair of outward flanges 21 are formed at lower ends of side walls 20 of housing A.

The water storage tank 40 is opened at its upper portion and is formed at its upper end with a pair of spaced outward flanges 41 which are engaged with the outward flanges 21 of side walls 20 and fixed in place by means of fastening screws to store an amount of fresh water supplied from an external source of water in the water storage tank 40. The water storage tank 40 is provided at a bottom portion thereof with an outlet port 42 which is connected to an inlet port of a water pump (not shown) whose outlet port is connected to a water supply port 53 of the sprinkler 50. The sprinkler 50 is in the form of a plurality of flattened conduits 51 arranged in parallel to form mutually communicated water passages. The flattened conduits 51 are formed thereon with a plurality of nozzles 52, respectively. The sprinkler 50 is formed at its opposite sides with a pair of upward flanges 54 which are fixed to internal surfaces of the side walls 20 of housing A by means of fastening screws. At an ice making cycle in operation of the ice maker, the fresh water in water storage tank 40 is supplied into the sprinkler 50 under operation of the water pump and spouted upward from the nozzles 52 of sprinkler 50.

Figure 2:
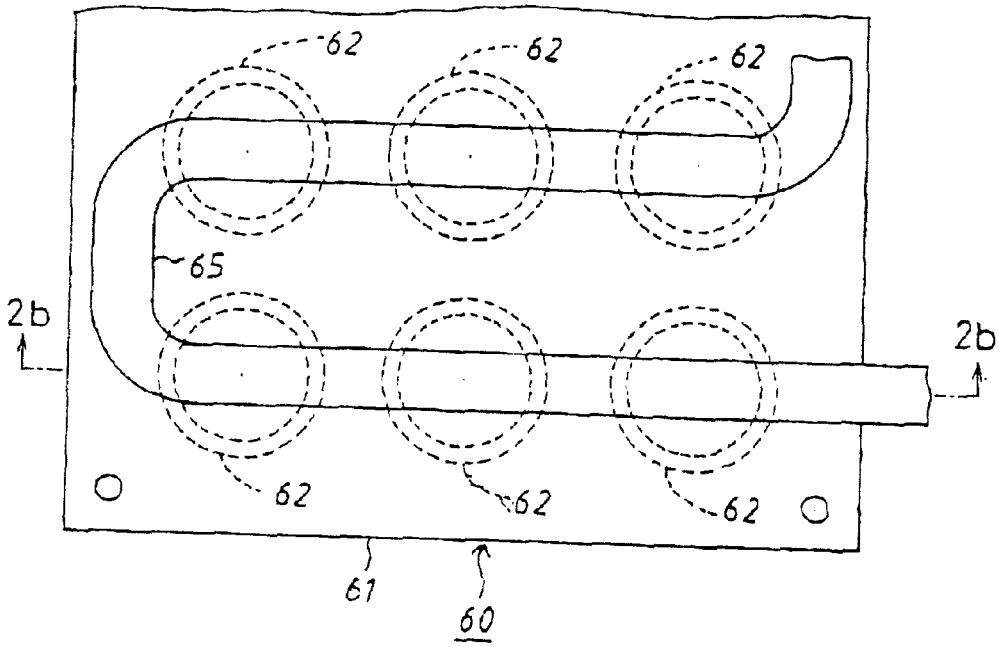
FIG. 2(*a*) is a plan view of a cooling pipe located in a cooling chamber shown in FIG. 1.
Figure 2:
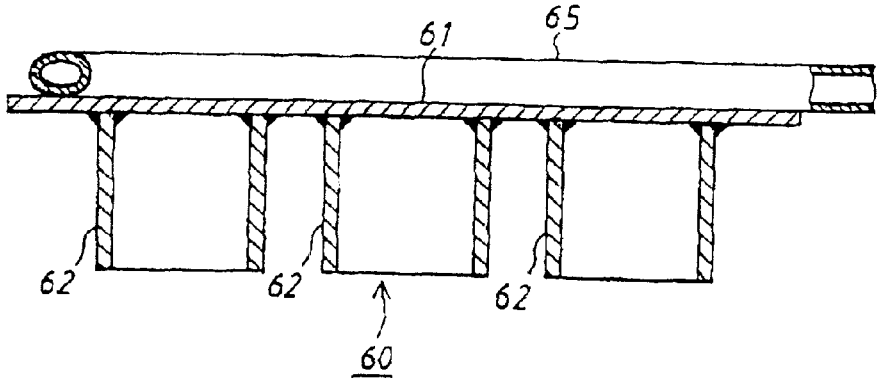
Figure 8:
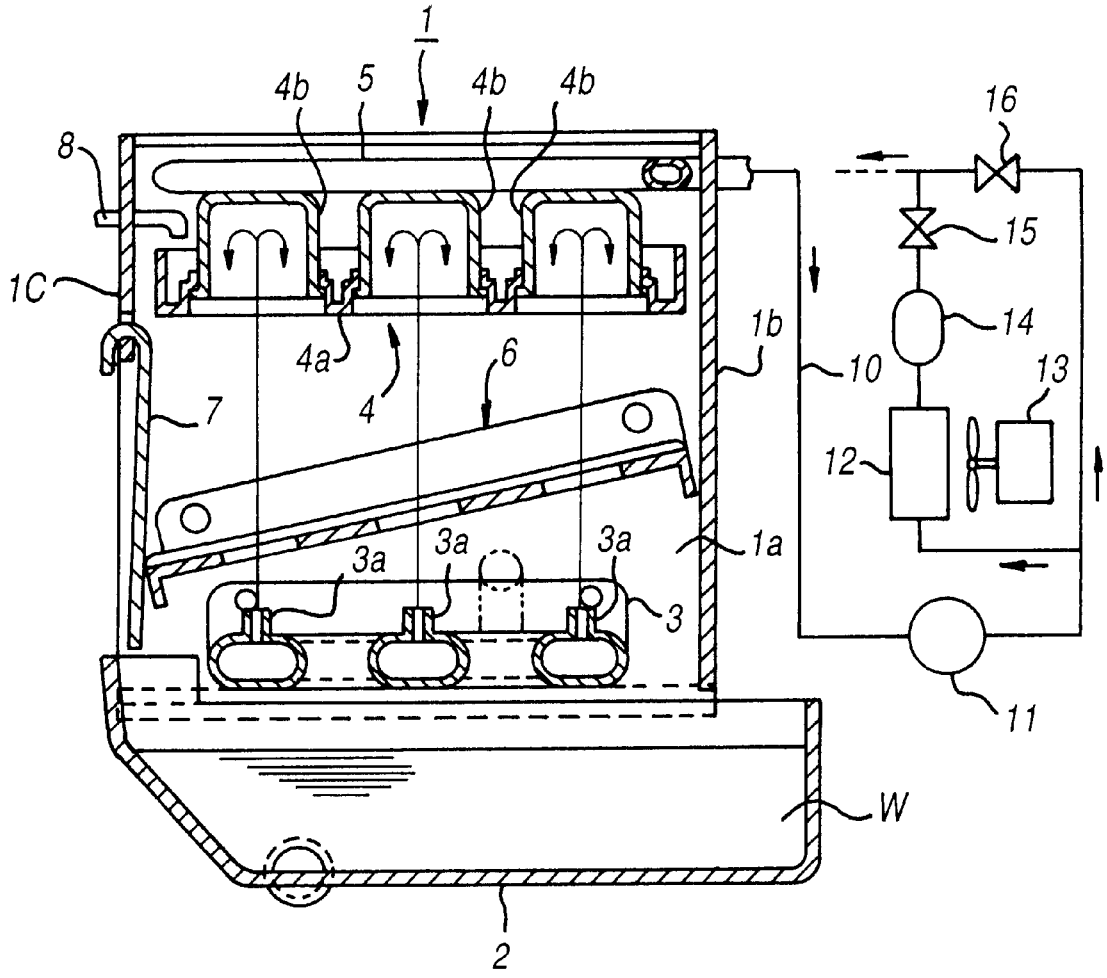
Fig. 8 RELATED ART
FIG. 8 is a vertical sectional view of a conventional ice maker of the open-cell type.

As shown in FIG. 1, the ice making chamber 60 is located above the sprier 50 and formed by a flat mounting base plate 61 which is provided with a plurality of ice making cell casings secured to its bottom surface. As shown in FIG. 2(*a*), the ice making cell casings 62 each are in the form of a cylindrical body which is opened downward and welded to the bottom surface of base plate 61 at a position located above each nozzle 52 of sprinkler 50. The ice making cell casings 62 are spaced in a predetermined distance to one another. The base plate 61 and ice making cell casings 62 are made of copper or aluminum superior in heat conductivity. Provided on the base plate 61 is a cooling pipe 65 which is meanderingly arranged to be located above each center of the ice making cell casings 62 and subjected to tin dipping treatment after welded in place to the flat mounting base plate 61. The cooling pipe 65 is supplied with cooled refrigerant from a freezing circuit as in the conventional ice maker shown in FIG. 8. The mounting base plate 61 is fixed to the side walls 20 of housing A at its opposite sides by means of fastening screws (not shown).

The ice chute 70 is composed of a plurality of spaced parallel vertical plates 71 which are connected by a plurality of spaced parallel lateral plates 72 in the form of a lattice. The ice chute is made of synthetic resin and is integrally formed in entirety. The ice chute 70 is fixed at its opposite side flanges 74 to the side walls 20 of housing A by means of fastening screws in a condition where the front side of ice chute 70 is inclined downward.

During an ice making cycle in operation of the ice maker, the cooling pipe 65 is supplied with cooled refrigerant from the freezing circuit to cool the cooling chamber 60, while the water pump is activated to supply the ice making water into the sprinkler 50 from the water storage tank 40 so that the ice making water is spouted upward from the nozzles 52 of sprinkler 50. In such an instance, the ice making water is spouted into each interior of the ice making cell casings 62 across the openings 73 of ice chute 70 and frozen in the ice making cell casings 62, and a remainder of the water is returned into the water storage tank 40 and supplied into the sprinkler 50 to be spouted into the ice making cell casings 62. Thus, ice cubes formed in the ice making cell casings 62 are enlarged in the course of lapse of a time. When the ice making cell casings 62 are filled with the ice cubes, the cooling pipe 65 is supplied with hot-gas at a defrost cycle in operation to heat the ice making chamber 60 thereby to release the ice cubes from the ice making cell casings 62. The released ice cubes are received by the ice chute 70 and slip on the ice chute to open the shutter 39. Thus, the ice cubes are delivered into an ice storage cabinet (not shown) through the shutter 39.

As in the ice maker, the cooling pipe 65 is welded to the mounting base plate 61 without any space, the base plate 61 is useful to effect heat transfer from the ice making cell casings 62 to the refrigerant at the entirety of cooling pipe 65 during the ice making cycle in operation. This is effective to enhance the ice making performance of the ice maker in a simple construction. During the defrost cycle in operation of the ice maker, the base plate 61 is also useful to effect heat transfer to the ice making cell casings 62 at the entirety of cooling pipe 65. This is effective to heat the ice making cell casings 62 in a short time thereby to release the ice cubes from the ice making cell casings without using any water for defrost as in the conventional ice maker. This is also useful for saving the city service water used for defrost heretofore and useful to provide the ice maker without the provision of an ice making dish plate and a water supply conduit used in the conventional ice maker shown in FIG. 8.

Figure 3:
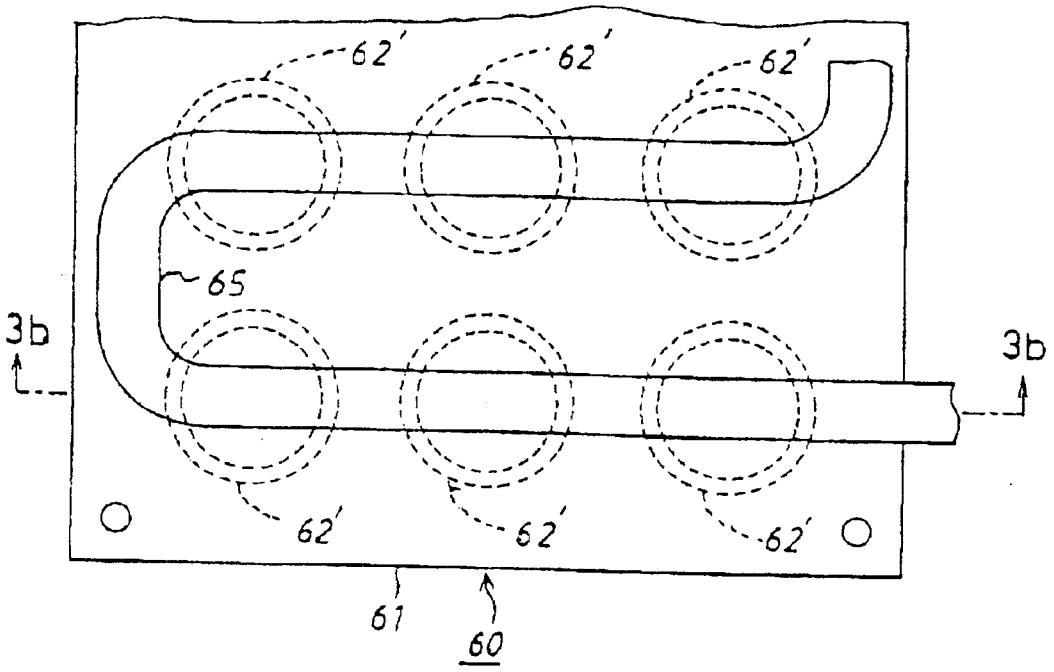
FIG. 3(*a*) is a plan view of a cooling pipe in a modification of the ice maker shown in FIG. 1.
Figure 3:
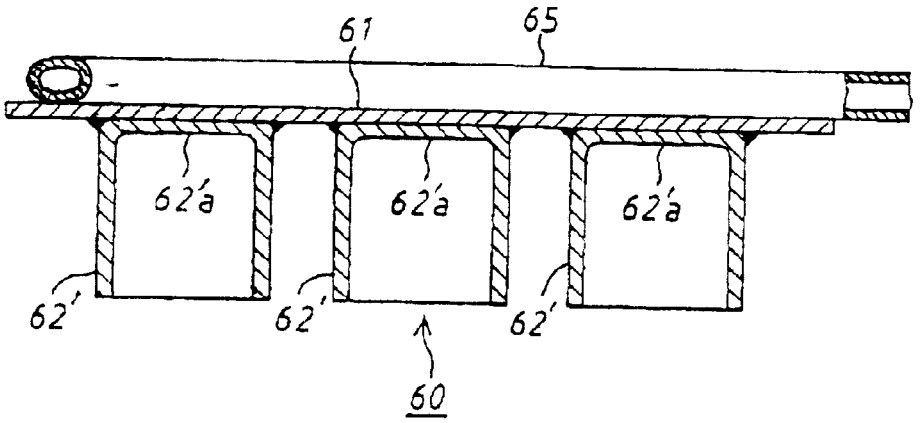

Although in the embodiment shown in FIGS. 2(*a*) and 2(*b*), the ice making cell casing 62 has been formed in a cylindrical body, the ice making cell casing 62 may be replaced with a cup-shaped cell casing 62' welded at its bottom 62'*a* to the base plate 61 as shown in FIGS. 3(*a*) and 3(*b*). In the embodiment, it is preferable that the ice making cell casings 62 are secured to the base plate 61 by braze welding in a vacuum furnace. With the braze welding, the plurality of ice making cells can be welded to the base plate at once to reduce the manufacturing processes of the ice maker.

Figure 4:
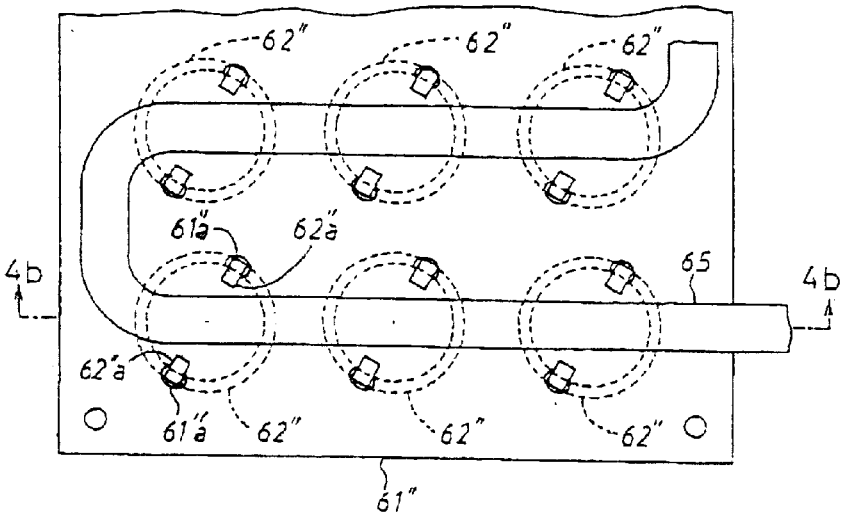
FIG. 4(*a*) is a plan view of a cooling pipe in another modification of the ice maker shown in FIG. 1.
Figure 4:
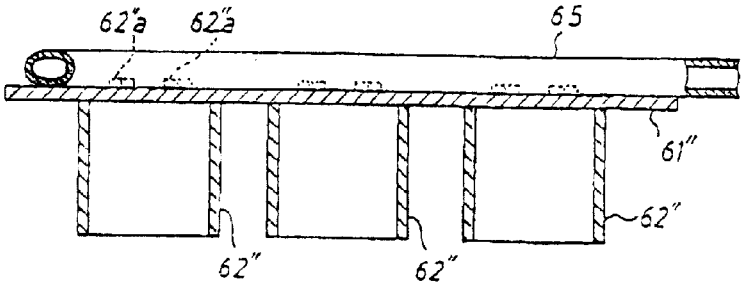
Figure 4:
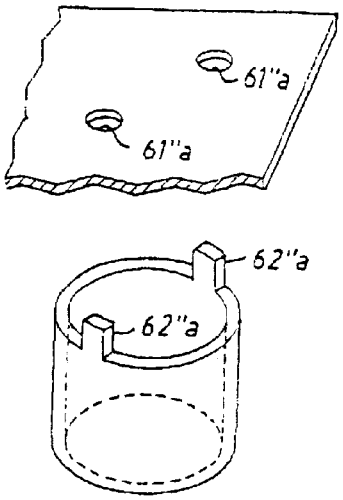
Figure 4:
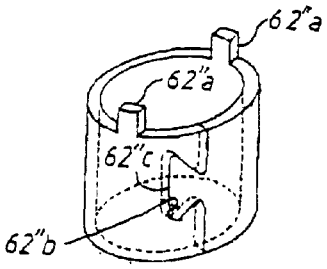

Illustrated in FIGS. 4(*a*)–4(*d*) is a modification of the ice making cell casing 62, wherein the ice making cell casing 62 is replaced with an ice making cell casing 62" in the form of a piece of pipe which is formed at one end thereof with a pair of diametrically opposed projections 62"*a*, while the base plate 61 is formed with mounting holes 61"*a* which correspond with the projections 62"*a* of ice making cell casing 62". As shown in FIGS. 4(*a*) and 4(*b*), the projections 62"*a* of each ice making cell casing 62" are inserted into the corresponding mounting holes 61" of base plate 61 and folded in a condition where the upper end of cell casing 62" is retained in contact with the bottom surface of base plate 61. In such a manner, each ice making cell casing 62" can be secured to the base plate 61 without causing any thermal deformation during the manufacturing process. In addition, as shown in FIG. 4(*d*), the ice making cell casing 62" may be manufactured by bending a rectangular sheet metal in a cylindrical body and engaging a trapezoid projection 62"*c* formed on one end of the sheet metal with a trapezoid recess 62"*b* formed on the other end of the sheet metal.

Figure 5:
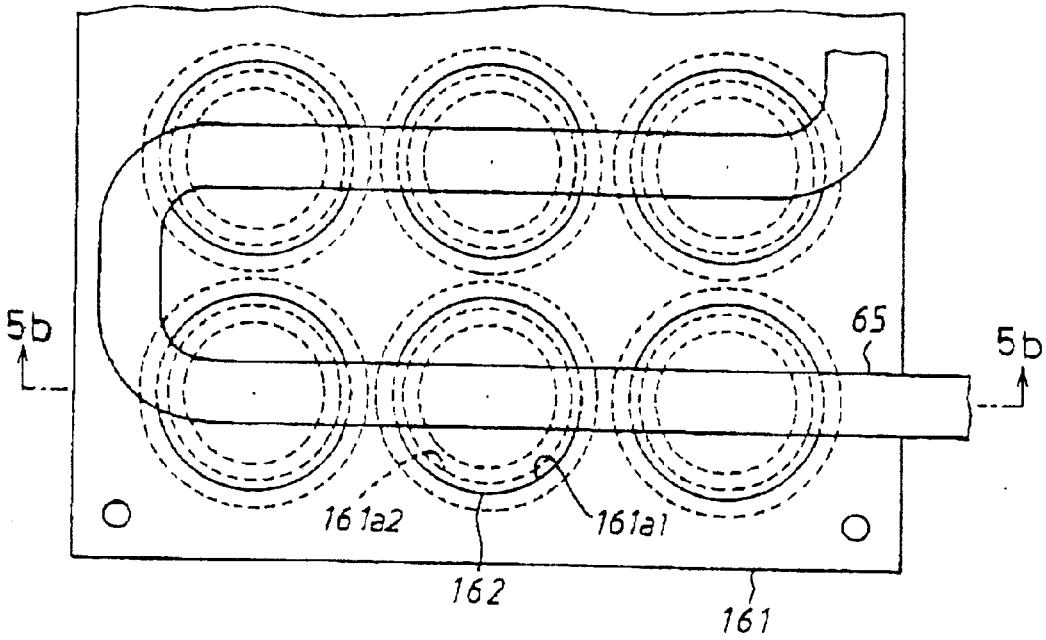
FIG. 5(*a*) is a plan view of a cooling pipe in a further modification of the ice maker shown in FIG. 1.
Figure 5:
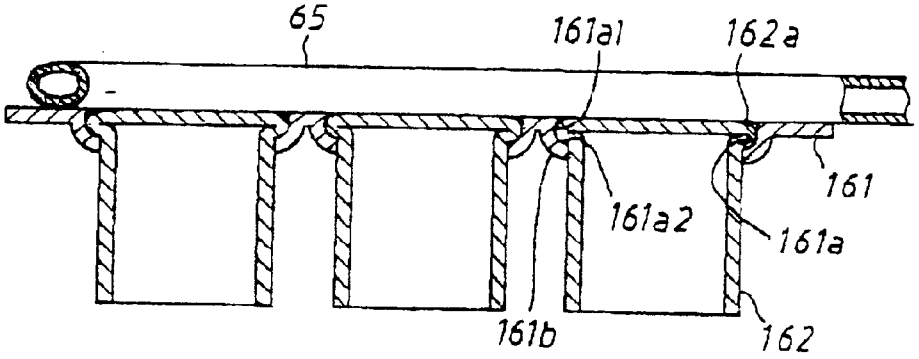

Illustrated in FIGS. 5(*a*) and 5(*b*) is another modification of the ice making cell casing, wherein the ice making cell casing 62 is replaced with a cup-shaped cell casing 162 formed at its bottom with an annular flange 162*a* which is fixedly coupled with the corresponding mounting hole 161*a* formed in a mounting base plate 161. The base plate 161 and cup-shaped cell casing 162 are made of copper or aluminum superior in heat conductivity.

In the manufacturing process of the cup-shaped cell casing 162, the annular flange 162*a* is formed by pressing the bottom of cup-shaped cell casing 162 in such a manner that an outer periphery of the bottom is protruded radially outwardly. On the other hand, the mounting hole 161 a of base plate 161 is formed with an annular flange 161*b* which forms an annular recess 161*a*1 to be coupled with the annular flange 162*a* of cup-shaped cell casing 162. When the cup-shaped cell casing 162 has been inserted into the mounting hole 161 during the assembling process with the base plate 161, the annular flange 162*a* of cell casing 162 is coupled within the annular recess 161*a*1 formed by the annular flange 161*b* of mounting hole 161*a* and welded to the base plate 161 in such a manner that the bottom of cell casing 162 coincides with the upper surface of base plate 161. Thereafter, the cooling pipe 65 is placed on the base plate 161 in a position corresponding with all the cup-shaped cell casings 162 and welded to each bottom of cup-shaped cell casings 162 and the upper surface of base plate 161. Subsequently, the assembly of base plate 161, cup-shaped cell casings 162 and cooling pipe 65 is subjected to tin dipping treatment.

Figure 6:
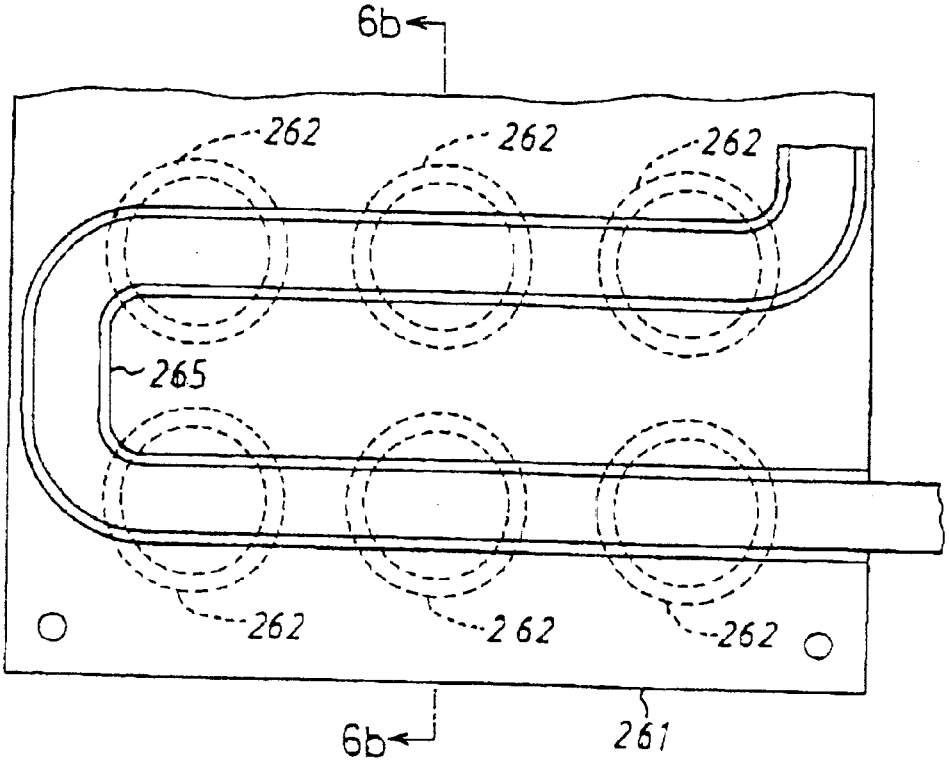
FIG. 6(*a*) is a plan view of a cooling pipe in a modification of the ice maker shown in FIG. 1.
Figure 6:
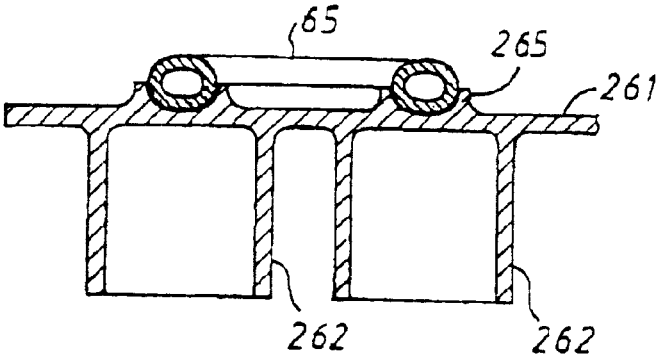

Although in the embodiment described above, the base plate 61 and ice making cell casings 62 have been separately prepared, a plurality of ice making cell casings 262 may be integrally formed with a base plate 261 as illustrated in FIGS. 6(*a*) and 6(*b*). In this modification, the ice making cell casings 262 are integrally formed with the base plate 261 in such a manner as to open downward, and the base plate 261 is formed thereon with an elongated support portions 265 along the entirety of cooling pipe 65 located above the cell casings 262 Thus, the cooling pipe 65 is positioned by engagement with the elongated support portion 265 of base plate 261 and welded in place by braze welding. With such assembly construction, the contact area of cooling pipe 65 with the base plate 261 is enlarged to enhance the ice making performance of the ice maker.

Figure 7:
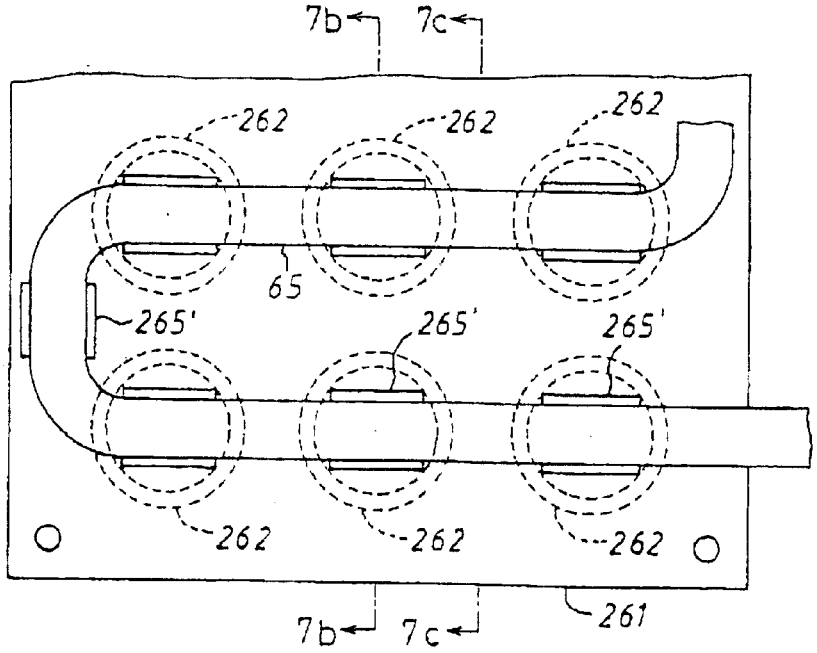
FIG. 7(*a*) is a plan view of a cooling pipe in an another modification of the ice maker shown in FIG. 1.
Figure 7:
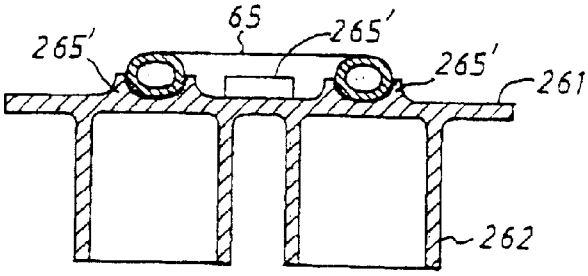
Figure 7:
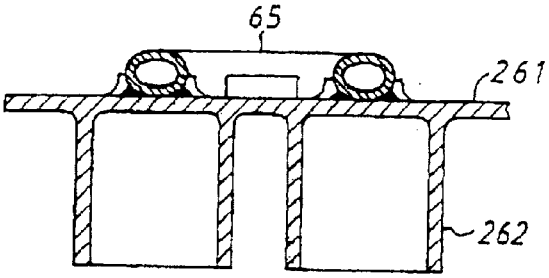

As illustrated in FIGS. 7(*a*)–7(*c*), the base plate 261 may be integrally formed thereon with a plurality of spaced support portions 265' respectively located above the cell casings 262 for receiving the cooling pipe 65. In such a case, the cooling pipe 65 is positioned by engagement with the spaced support portions 265' of base plate 261 and retained in contact with the upper surface of base plate 261 at each space between the support portions 265'.

What is claimed is:

1. An automatic ice maker of the open-cell type including a box-type housing, a plurality of spaced ice making cell casings arranged on a horizontal plane in an upper portion of the housing and opened downward, a cooling pipe mounted on the cell casings to be supplied with refrigerant from a freezing circuit, and a sprinkler mounted within a bottom portion of the housing and placed under the cell casings to spout ice making water into the respective cell casings, wherein a base plate is mounted within the upper portion of the housing to form an ice making chamber, and wherein the cooling pipe is mounted on the base plate at positions located above the cell casings and welded to an upper surface of the base plate, wherein the ice making cell casings each are in the form of a cylindrical body formed at one end thereof with a plurality of projections which are inserted into corresponding mounting holes formed in the base plate and folded in a condition wherein the one end of the cylindrical body is retained in contact with the bottom surface of the base plate.

2. An automatic ice maker of the open-cell type including a box-type housing, a plurality of spaced ice making cell casings arranged on a horizontal plane in an upper portion of the housing and opened downward, a cooling pipe mounted on the cell casings to be supplied with refrigerant from a freezing circuit, and a sprinkler mounted within a bottom portion of the housing and placed under the cell casings to spout ice making water into the respective cell casings, wherein a base plate is mounted within the upper portion of the housing to form an ice making chamber, and wherein the cooling pipe is mounted on the base plate at positions located above the cell casings and welded to an upper surface of the base plate, wherein the base plate is formed with a plurality of mounting holes located at positions corresponding with the ice making cell casings, wherein the ice making cell casings each are in the form of cup-shaped casing formed at its bottom with an annular flange which is coupled with the respective mounting holes of the base plate and welded to the base plate in a condition where the bottom of the cup-shaped casing coincides with the upper surface of the base plate, and wherein the cooling pipe is welded to the upper surface of the base plate in its entire length.

3. An automatic ice maker as claimed in either one of claim 1 and 2, wherein the ice making cell casings each are in the form of cylindrical body welded at one end thereof to the bottom surface of the base plate.

4. An automatic ice maker as claimed in either one of claim 1 and 2, wherein the ice making cell casings each are in the form of a cup-shaped casing welded at its bottom to the bottom of the base plate by braze welding.

5. An automatic ice maker as claimed in either one of claim 1 and 2, wherein the ice making cell casings are integrally formed with the bottom surface of the base plate, while the cooling pipe is mounted on the base plate along positions located above said each center of the cell casings and welded to the upper surface of the base plate.

6. An automatic ice maker as claimed in claim 5, wherein the base plate is formed thereon with a support portion along positions located above said each center of the cell casings, and wherein the cooling pipe is positioned in engagement with the support portion of the base plate and welded to the base plate.

* * * * *